United States Patent [19]

Alford

[11] 4,209,211

[45] Jun. 24, 1980

[54] VENDOR WITH DOOR AND SHELF INTERLOCK

[75] Inventor: James R. Alford, Florissant, Mo.

[73] Assignee: UMC Industries, Inc., Stamford, Conn.

[21] Appl. No.: 946,709

[22] Filed: Sep. 28, 1978

[51] Int. Cl.[2] ..... A47F 1/00; G07F 11/00

[52] U.S. Cl. ..... 312/215; 312/35; 312/138 R; 312/319; 221/13

[58] Field of Search ..... 312/35, 291, 215, 218, 312/138 R, 107.5, 319; 221/13, 85

[56] References Cited

U.S. PATENT DOCUMENTS

| | | | |
|---|---|---|---|
| 2,371,316 | 3/1945 | Rice et al. | 221/13 |
| 2,921,575 | 1/1960 | Fry | 312/319 |
| 3,269,595 | 8/1966 | Krakauer et al. | 312/35 |
| 3,374,043 | 3/1968 | Lewin | 312/319 |
| 3,521,939 | 7/1970 | Fall et al. | 312/215 |
| 3,575,480 | 4/1971 | Peisker | 312/319 |
| 3,752,546 | 8/1973 | O'Neil | 312/35 |
| 4,046,440 | 9/1977 | Cox et al. | 312/138 R |

*Primary Examiner*—Victor N. Sakran

*Attorney, Agent, or Firm*—Senniger, Powers, Leavitt and Roedel

[57] ABSTRACT

A vendor comprising a cabinet having a front door and shelves in the cabinet for holding items to be vended, the shelves being slidable into and out of the cabinet, the vendor having a door and shelf interlock for locking the shelves in vending position in the cabinet unless the door is opened far enough to enable the shelves to be pulled out for loading without striking the door, and for locking the door in open position unless all the shelves are slid in to their vending position, the interlock operating automatically on swinging the door to open position to lock the door in open position and to unlock the shelves, and operating automatically on pushing the shelves in to vending position to unlock the door, the shelves then being automatically locked in vending position on swinging the door toward its closed position.

14 Claims, 7 Drawing Figures

VENDOR WITH DOOR AND SHELF INTERLOCK

BACKGROUND OF THE INVENTION

This invention relates to vendors, and more particularly to a vendor of the type comprising a cabinet having a front door and shelves in the cabinet for holding items to be vended, the shelves having a vending position in the cabinet with the door closed, and being slidable forward to a loading position extending forward from the cabinet when the door is open.

The door and shelf interlock of this invention may be regarded as an improvement upon the door and shelf interlock shown in the co-assigned Cox et al. U.S. Pat. No. 4,046,440, issued Sept. 6, 1977. The earlier door and shelf interlock was developed primarily for a spiral vendor such as shown in said U.S. Pat. No. 4,046,440; the door and shelf interlock of this invention was developed primarily for the vendor shown in the co-assigned Falk et al U.S. Pat. No. 4,108,333, issued Aug. 22, 1978.

SUMMARY OF THE INVENTION

Among the several objects of this invention may be noted the provision of an improved door and shelf interlock for a vendor having a front door and slide-in slide-out shelves for locking the shelves in vending position in the vendor cabinet unless the door is opened far enough to enable the shelves to be slid out without striking the door, and for locking the door in open position unless all the shelves are slid in to their vending position; and the provision of such an interlock which is operable automatically on swinging the door to open position to lock the door in open position and to unlock the shelves, and operable automatically on pushing the shelves in to vending position to unlock the door, the shelves then being automatically locked in vending position on swinging the door toward its closed position.

In general, interlock means of this invention is used in a vendor comprising a cabinet having a front door hinged at one side of the cabinet to swing open and closed and a plurality of shelves in the cabinet for holding items to be vended, each shelf being mounted for sliding movement in rear-to-front direction for being pulled out from a vending position within the cabinet to a loading position extending forward from the cabinet when the door is swung open. The interlock means locks the shelves in vending position unless the door is swung to an open position enabling the shelves to be slid out without striking the door, and locks the door in open position unless all the shelves are slid in to their vending position, thereby preventing the door from being struck by a shelf if the shelf is pulled out with the door only partly open, and preventing the door from being closed against a pulled-out shelf. The interlock means comprises a locking member mounted in the cabinet at said one side thereof for movement between a first position wherein the door is unlocked and the shelves are locked in vending position, and a second position for locking the door in open position and unlocking the shelves. Means is provided interconnecting the door and locking member for movement of the locking member by the door from its first to its second position when the door is swung to its open position, and vice versa. A lock bar is mounted in the cabinet at said one side of the cabinet for up and down movement between a first position wherein the door is unlocked and the shelves are locked in vending position, and a second position wherein the door is locked in open position and the shelves are unlocked. The lock bar is biased to its first position and is prevented by said locking member from moving to its second position when the locking member is in its first position and is movable to its second position against the bias when the locking member is in its second position. A series of detents is provided, one for each shelf, each mounted in the cabinet at said one side of the cabinet for movement between a first position wherein the respective shelf is locked in vending position, and a second position wherein it releases the shelf and locks the door in open position. Each shelf has a member at said one side of the cabinet engageable with the respective detent when the detent is in its first position and the lock bar is held in its first position by the locking member for locking the shelf in vending position, said member on each shelf moving the respective detent to its second position for release of the shelf when, with the lock bar in its second position, the shelf is pulled out.

Other objects and features will be in part apparent and in part pointed out hereinafter.

BRIEF DESCRIPTION OF THE DRAWINGS

Corresponding reference characters indicate corresponding parts throughout the several views of the drawings.

Description of the Preferred Embodiment

Figure 1:
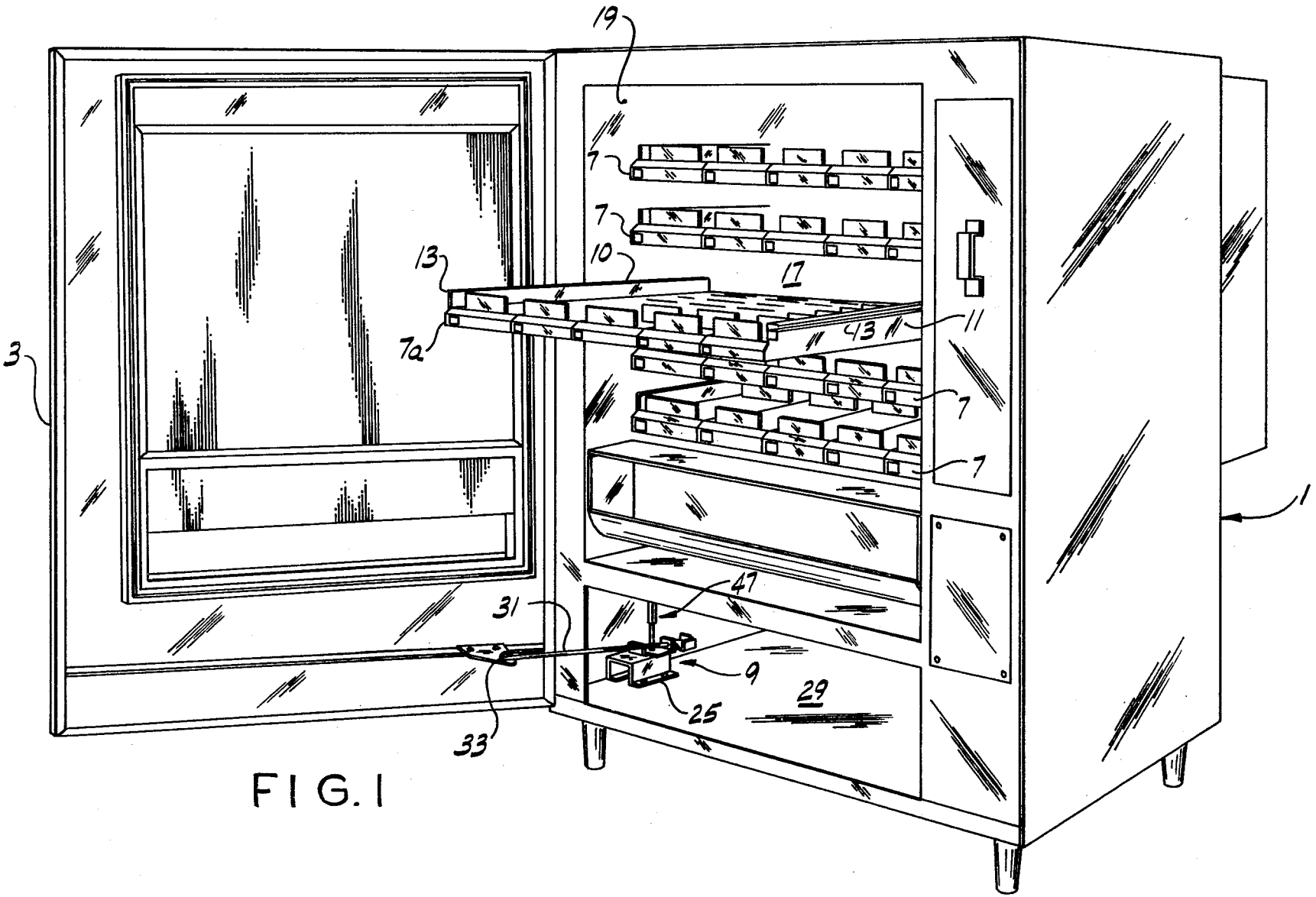
FIG. 1 is a perspective of a vendor having an interlock of this invention, showing the front door of the vendor open and one of the shelves of the vendor pulled out.
Figure 6:
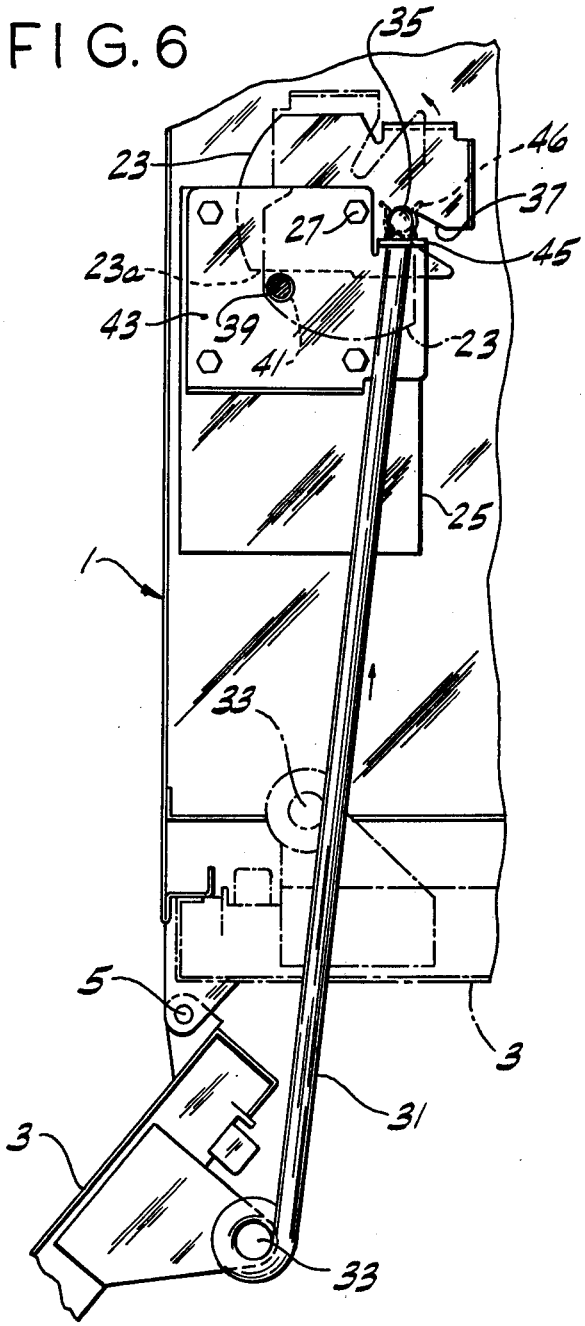
FIG. 6 is a view showing parts of the interlock at the lower left front of the cabinet.
Figure 7:
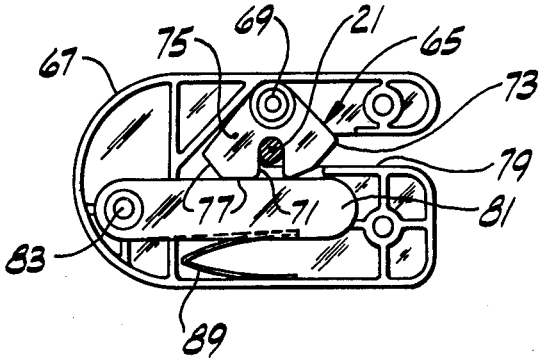
FIG. 7 is a view on line 7—7 of FIG. 5, showing the interior of a detent housing.

Referring to the drawings, a vendor incorporating the present invention is shown generally to comprise a cabinet 1 having a front door 3 hinged at one side, the left side as indicated at 5 in FIG. 6, to swing open and closed. Within the cabinet there are a plurality of shelves or trays 7, one above another, for holding items to be vended. As shown, there are five such shelves. The vendor is of the type shown in the aforesaid U.S. Pat. No. 4,108,333 particularly for vending food items, each of the shelves having endless belt means thereon as shown in said patent for dispensing items therefrom. Each shelf is mounted in the cabinet for sliding movement in rear-to-front direction for being slid out from a vending position wholly within the cabinet to a loading position extending forward from the cabinet (as shown for the shelf indicated at 7*a* in FIG. 1) when the door is swung open. Door and shelf interlock means, indicated generally at 9 in FIG. 1, and involving an improvement upon the door and shelf interlock means shown in the aforesaid U.S. Pat. No. 4,046,440, is provided for locking the shelves in the vending position within the cabinet unless the door is opened far enough to enable the shelves to be slid out without striking the door, and for locking the door in open position unless all the shelves are slid in to their vending position wholly within the cabinet, thereby to prevent the door from being struck by a shelf if the shelf is pulled out with the door only partly opened, and to prevent the door from being closed against a pulled-out shelf.

Figure 5:
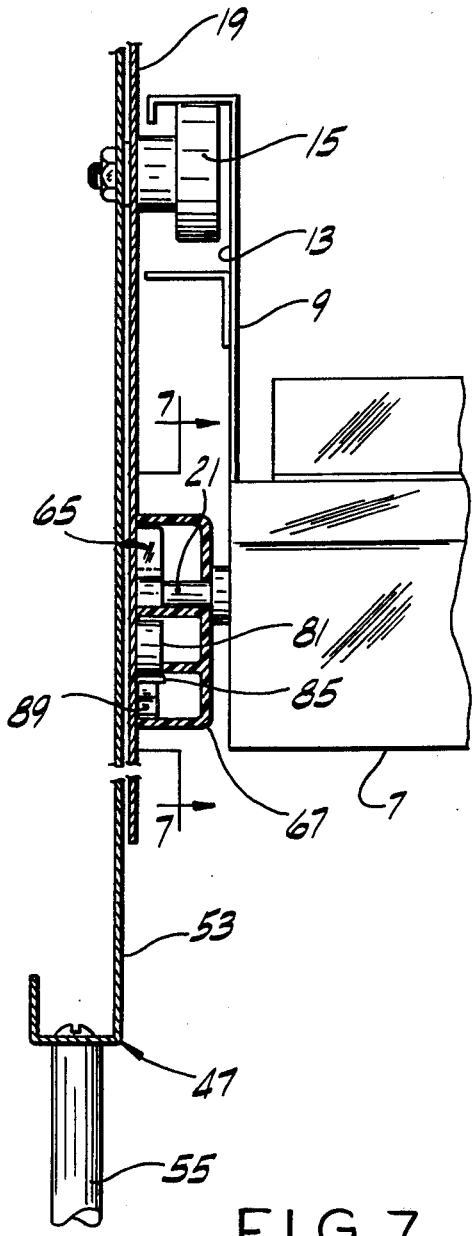
FIG. 5 is a vertical section on line 5—5 of FIG. 3.

Each shelf has left and right side walls 10 and 11, each of these side walls having a channel 13 (see FIG. 5) on the outside receiving rollers 15 mounted on partitions extending from front to rear in the cabinet at the sides of the space 17 in the cabinet for the shelves, mounting the shelves for being slid in rear-to-front direction. The partition at the left of said space is indicated at 19. This is located adjacent the left side of the cabinet. Each shelf also has a pin 21 extending laterally outward from its left side wall 9 adjacent the forward end of the shelf for a purpose to be described.

Figure 3:
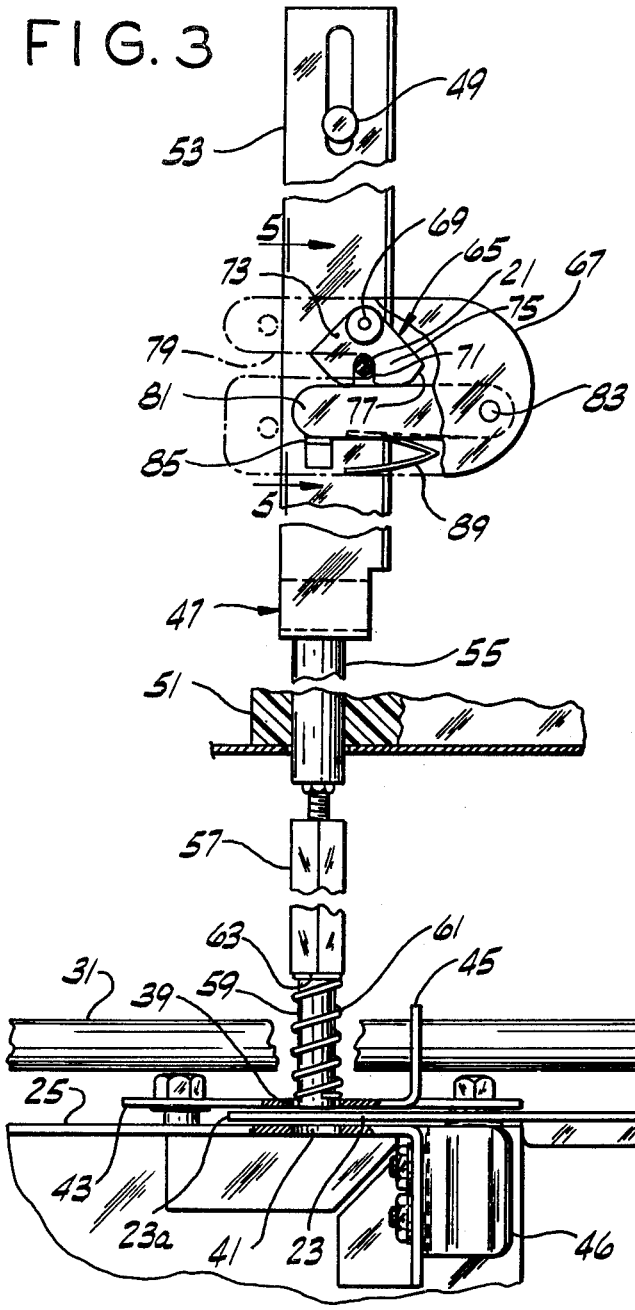
FIG. 3 is a view in elevation with parts broken away and shown in section showing parts of the interlock in a position in which the shelves are locked in the cabinet and the door is unlocked.
Figure 4:
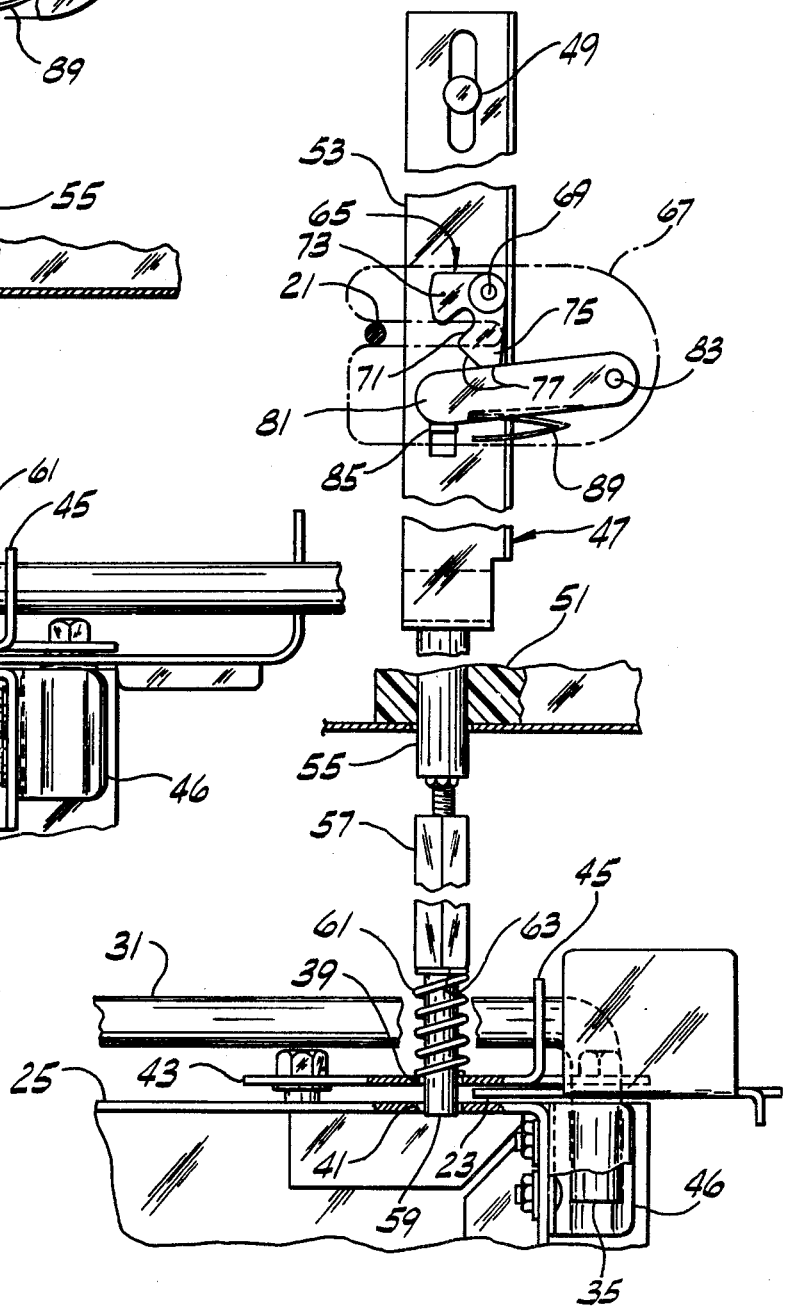
FIG. 4 is a view similar to FIG. 3 showing the parts in a position in which the door is locked in open position, the shelves being unlocked.

A locking member 23 (see FIGS. 3, 4 and 6) is mounted in the cabinet at the left side of the cabinet on a support 25 for swinging movement on a vertical axis between a first position, in which it is shown in phantom in FIG. 6, wherein the door 3 is unlocked and the shelves are locked in the stated vending position within the cabinet, and a second position, in which it is shown in solid lines in FIG. 6, for locking the door in open position and unlocking the shelves, all in a manner that will appear. The locking member 23 is constituted by a sheet metal shutter plate pivoted at 27 on top of the support 25, which is of channel shape in section, and secured on the bottom 29 of the cabinet (see FIG. 1). Means constituted by a link 31 pin-connected at 33 to the door and having a bent-down end 35 received in a slot 37 in the shutter 23 interconnects the door and the shutter for movement of the latter by the door from its first to its second position when the door is swung to its open position, and vice versa. In its first position (FIG. 3, phantom in FIG. 6), the shutter 23 blocks aligned holes 39 and 41 in the top of the support 25 and in a plate 43 mounted on the support overlying the shutter; in its second position, the shutter clears the holes (see FIG. 4). The plate 43 has a bent-up apertured tang 45 forming a guide for the link 31. The arrangement is such that when the door 3 is closed, the shutter 23 blocks the holes 39 and 41 (FIGS. 3 and 6). When the door is swung to its full open position (FIG. 6), the shutter is swung clear of the holes (FIG. 4). In the pulled-out door-open position of link 31, its bent-down end 35 is releasably gripped in a clip indicated at 46 in FIGS. 3 and 4.

A lock bar 47 is mounted in the cabinet at the left side of the cabinet for up and down movement between a first position (see FIG. 3) wherein the door 3 is unlocked so that it may be opened and closed and wherein the shelves 7 are locked in vending position, and a second position (see FIG. 4) wherein the door is locked in open position and the shelves are unlocked (all in a manner that will appear). This lock bar is suitably guided as indicated at 49 and 51 for vertical sliding movement in the space between the left side of the cabinet and the partition 19. It has an upper section 53 constituted by a sheet metal bar, an intermediate section 55 extending down from the lower end of the upper section 53, and a lower section 57 adjustably secured to and extending down from the lower end of the intermediate section 55. The lower section has an upper part of square cross section and lower part 59 of circular cross section dimensioned to have a loose sliding fit in the holes 39 and 41. The lock bar 47 is biased upward to its first position of FIG. 3 (which is a raised position) by a coil compression spring 61 surrounding the lower part 59 of section 57 reacting from the plate 43 against the shoulder 63 at the lower end of the square part of section 57. In the first or raised position of the lock bar (FIG. 3), its lower end is located in the hole 39 in plate 43 above the shutter 23. On movement of the shutter 23 to clear the holes 39 and 41 (FIG. 4), the lock bar is adapted to move down against the bias of spring 61, the lower end of the lock bar passing down through the hole 41. Thus, the lock bar is prevented by the locking member or shutter 23 from moving to its second position when the shutter is in its first position (FIG. 3), and is movable to the second position against the bias of spring 61 when the shutter is in its second position (FIG. 4). When the lock bar moves down to its second (FIG. 4) position, it lies in front of an edge **23*a* of the shutter to lock the shutter against counterclockwise movement as viewed in FIG. 6 from its second position (solid lines in FIG. 6) back to its first position (phantom in FIG. 6**) thereby to lock the door in open position.

Figure 2:
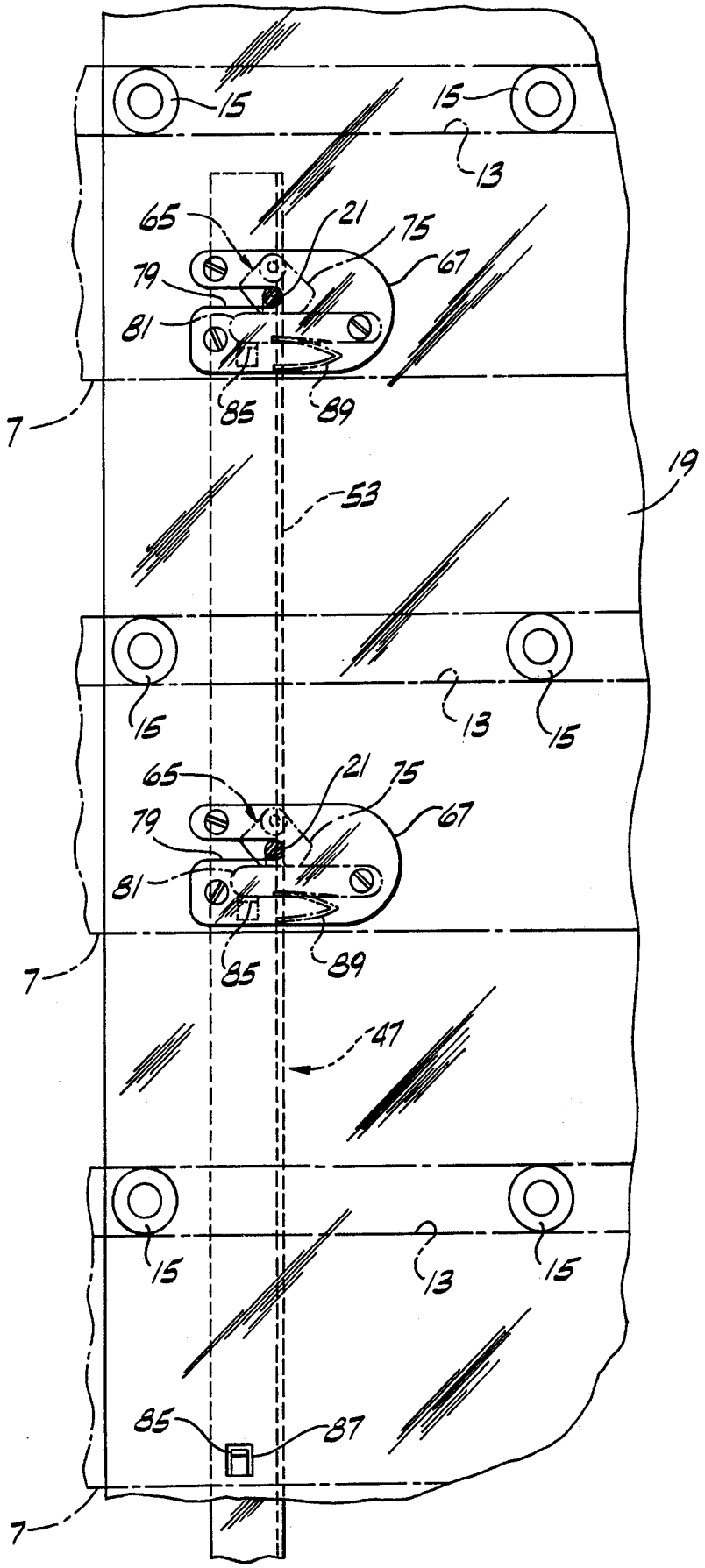
FIG. 2 is a view in elevation showing certain detent housings of the interlock.

A series of detents 65 is provided, one for each of the shelves 7 in the cabinet. With five shelves, there are five such detents, spaced in a vertical series each at the level of the respective shelf. Only two of the detents are shown in FIG. 2 and only one in FIGS. 3 and 4 to conserve drawing space. Each detent 65 is mounted in a molded plastic detent housing 67 secured to partition 19 at the left of the shelves with the detent movable in the housing between a first position (FIG. 3) wherein the respective shelf 7 is locked in vending position and a second position (FIG. 4) wherein it releases the shelf and locks the door 3 in open position (as will appear). The detent 65 is generally of sector shape, pivoted at 69 on a pin formed integrally with the housing and having an open-ended radial slot 71. The slot in effect divides the detent into a forward arm 73 and a rearward arm 75. The rearward arm 75 has a cam formation 77 at its end.

The detent housing 67 has an open-ended slot 79 extending rearward from its forward end. The pivot 69 for the detent 65 is above the rearward end portion of this slot. In the first position of the detent (FIG. 3), the slot 71 in the detent extends generally vertically downward, intersects the rearward end portion of the slot 79 in the detent housing, and receives the pin 21 of the corresponding shelf 7 when the shelf is in its vending position. An interconnection between each detent 65 and the lock bar 47 is provided by a follower constituted by an arm 81 pivoted at 83 in the housing 67 for the detent on a pin formed integrally with the housing, and a lug 85 formed on the upper section 53 of the lock bar engageable by the follower or arm 81 (the upper section 53 of the lock bar having a lug 85 for each of the arms 81 for the detents). Each lug 85 extends from section 53 of bar 47 through a slot 87 in partition 19, reaching underneath the detent. The follower or arm 81 extends below the detent and is biased upwardly into engagement with the cam formation on the detent by a leaf spring means 89 in the housing. The lock bar 47 being biased upward by the spring 61, the lugs 85 on the lock bar are maintained in engagement with the bottom of the arms 81. The cam formation 77 on the end of arm 75 of the detent 65 is shaped to cam the arm 81 down as the detent swings forward (clockwise as viewed in FIG. 3), the arm 81 thereupon acting to drive the lock bar down to its second position (if shutter 23 is in its retracted position freeing the lock bar to move down).

When any of the shelves 7 (including 7a) is pushed into its vending position within the cabinet (as shown for the two upper and the two lower shelves in FIG. 1), the pin 21 on that shelf is received in the slot 71 of the respective detent and swings the detent to its stated first position wherein the slot 71 extends generally vertically downward (see FIGS. 2 and 3). With the detent in this first position, the respective arm 81 is held by its spring 89 in raised position against part of the cam formation 77 on the rearward arm 75 of the detent. With all of the arms 81 so raised, the lock bar 47 occupies its stated first or raised position (FIGS. 2 and 3) under the upward bias of spring 61, the lugs 85 on the lock bar engaging the bottoms of the arms 81.

Unless and until the door 3 is swung open far enough to enable the shelves to be pulled out for loading without striking the door (i.e., pulled out to its FIG. 1 open position clear of the shelves), the locking member or shutter 23 effects locking of the lock bar 47 in its FIG. 3 raised position. This is because the lower end of the lock bar (i.e., the lower end of part 59 of the lock bar) is engageable with the top of the shutter. With the lock bar 47 locked up in its FIG. 3 raised position, the detents 65 are locked in their FIG. 3 position to lock the shelves in their vending position. The locking of the shelves in the vending position is by reason of the engagement of the pins 21 on the shelves with the forward arms 73 of the detents and the locking of the detents in their FIG. 3 position by the arms 81 held up by the lock bar 47 preventing the detents from swinging forward.

When the door 3 is swung to the open position (FIG. 1), link 31 swings the shutter 23 to its stated second position (FIG. 4, solid lines in FIG. 6) wherein the lower end of the lock bar is free to move down through the holes 39 and 41 from its first (FIG. 3) to its second (FIG. 4) position. With the lock bar thus freed for downward movement, arms 81 are freed to swing downward, pushing the lock bar downward as they do so, and all the detents are thus freed to swing forward to their second (FIG. 4) position, pushing the arms 81 downward as they do so. In other words, the locking effect of the lock bar on the detents is removed by the displacement of the shutter from below the lower end of the lock bar on opening the door. With each detent free to swing forward, the respective shelf may be readily pulled out for loading, the pin 21 on the shelf engaging the forward arm 73 of the respective detent and swinging the detent forward to its FIG. 4 position allowing for escape of the pin 21 from the slot 71, the pin leaving the slot 71 and passing forward through and out of the slot 79 in the detent housing 67.

Any detent 65, after having been swung to its stated second (FIG. 4) position by the pin 21 on the respective shelf when the shelf is pulled out, remains in that position and thus holds the lock bar 47 down in its stated second (FIG. 4) position wherein it locks the door in open position until the shelf is pushed back into its vending position within the cabinet. The door is locked in its open position by engagement of the bent-down end 35 of the link 31 with the shutter 23 and the locking of the shutter in its stated second or door-locking position (FIG. 4, solid lines in FIG. 6) by the engagement of edge 23a of the shutter 23 with the lower end section 59 of the lock bar.

When all the shelves are pushed back in from loading position to vending position, all the detents 65 occupy their first (FIG. 3) position, and the lock bar 47 is moved up by the spring 61 to its first (FIG. 3) position. The lower end portion 59 of the lock bar thus moves up clear of the shutter 23, unlocking the door and permitting it to be closed. When a shelf is pushed back in, the pin 21 on the shelf re-enters the slot 79 in the respective housing 67 and then re-enters the slot 71 in the respective detent and swings the detent back to its first (FIG. 3) position.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In a vendor comprising a cabinet having a front door hinged at one side of the cabinet to swing open and closed, a plurality of shelves in the cabinet for holding items to be vended, each shelf being mounted for sliding movement in rear-to-front direction for being pulled out from a vending position within the cabinet to a loading position extending forward from the cabinet when the door is swung open, interlock means for locking the shelves in said vending position unless the door is swung to an open position enabling the shelves to be slid out without striking the door, and for locking the door in open position unless all the shelves are slid in to their vending position, thereby to prevent the door from being struck by a shelf if the shelf is pulled out with the door only partly open, and to prevent the door from being closed against a pulled-out shelf, said interlock means comprising:

a locking member mounted in the cabinet at said one side thereof for movement between a first position wherein the door is unlocked and the shelves are locked in vending position, and a second position for locking the door in open position and unlocking the shelves;

means interconnecting the door and said locking member for movement of the locking member by the door from its first to its second position when the door is swung to its open position, and vice versa;

a lock bar mounted in the cabinet at said one side of the cabinet for up and down movement between a first position wherein the door is unlocked and the shelves are locked in vending position, and a second position wherein the door is locked in open position and the shelves are unlocked, said lock bar when in its first position being out of engagement with the locking member to enable movement of the locking member by the door;

said lock bar being biased to its first position and being prevented by said locking member from moving to its second position when the locking member is in its first position, and being movable to its second position against the bias when the locking member is in its second position;

a series of detents, one for each shelf, each mounted on the cabinet at said one side of the cabinet for movement between a first position wherein the respective shelf is locked in vending position and a second position wherein it releases the shelf and locks the door in open position;

each shelf having a member at said one side of the cabinet engageable with the respective detent when the detent is in its first position and the lock bar is held in its first position by the locking member for locking the shelf in vending position;

said member on each shelf moving the respective detent to its second position for release of the shelf when, with the lock bar in its second position, the shelf is pulled out, whereby, with the lock bar in its second position, one or more of the shelves may be pulled out at one time.

2. In a vendor comprising a cabinet having a front door hinged at one side of the cabinet to swing open and closed, a plurality of shelves in the cabinet for holding items to be vended, each shelf being mounted for sliding movement in rear-to-front direction for being pulled out from a vending position within the cabinet to a loading position extending forward from the cabinet when the door is swung open, interlock means for locking the shelves in said vending position unless the door is swung to an open position enabling the shelves to be slid out without striking the door, and for locking the door in open position unless all the shelves are slid in to their vending position, thereby to prevent the door from being struck by a shelf if the shelf is pulled out with the door only partly open, and to prevent the door from being closed against a pulled-out shelf, said interlock means comprising:

a locking member mounted in the cabinet at said one side thereof for movement between a first position wherein the door is unlocked and the shelves are locked in vending position, and a second position for locking the door in open position and unlocking the shelves;

means interconnecting the door and said locking member for movement of the locking member by the door from its first to its second position when the door is swung to its open position, and vice versa;

a lock bar mounted in the cabinet at said one side of the cabinet for up and down movement between a first position wherein the door is unlocked and the shelves are locked in vending position, and a second position wherein the door is locked in open position and the shelves are unlocked;

said lock bar being biased to its first position and being prevented by said locking member from moving to its second position when the locking member is in its first position, and being movable to its second position against the bias when the locking member is in its second position;

a series of detents, one for each shelf, each mounted on the cabinet at said one side of the cabinet for movement between a first position wherein the respective shelf is locked in vending position and a second position wherein it releases the shelf and locks the door in open position;

each shelf having a member at said one side of the cabinet engageable with the respective detent when the detent is in its first position and the lock bar is held in its first position by the locking member for locking the shelf in vending position;

said member on each shelf moving the respective detent to its second position for release of the shelf when, with the lock bar in its second position, the shelf is pulled out; said lock bar being engageable with the locking member when the locking member is in its first position to lock the lock bar in its first position thereby to lock the detents in first position;

said locking member being engageable with the lock bar when the lock bar is in its second position to lock the door in open position.

3. In a vendor comprising a cabinet having a front door hinged at one side of the cabinet to swing open and closed, a plurality of shelves in the cabinet for holding items to be vended, each shelf being mounted for sliding movement in rear-to-front direction for being pulled out from a vending position within the cabinet to a loading position extending forward from the cabinet when the door is swung open, interlock means for locking the shelves in said vending position unless the door is swung to an open position enabling the shelves to be slid out without striking the door, and for locking the door in open position unless all the shelves are slid in to their vending position, thereby to prevent the door from being struck by a shelf if the shelf is pulled out with the door only partly open, and to prevent the door from being closed against a pulled-out shelf, said interlock means comprising:

a locking member mounted in the cabinet at said one side thereof for movement between a first position wherein the door is unlocked and the shelves are locked in vending position, and a second position for locking the door in open position and unlocking the shelves;

means interconnecting the door and said locking member for movement of the locking member by the door from its first to its second position when the door is swung to its open position, and vice versa;

a lock bar mounted in the cabinet at said one side of the cabinet for up and down movement between a first position wherein the door is unlocked and the shelves are locked in vending position, and a second position wherein the door is locked in open position and the shelves are unlocked;

said lock bar being biased to its first position and being prevented by said locking member from moving to its second position when the locking member is in its first position, and being movable to its second position against the bias when the locking member is in its second position;

a series of detents, one for each shelf, each mounted on the cabinet at said one side of the cabinet for movement between a first position wherein the respective shelf is locked in vending position and a second position wherein it releases the shelf and locks the door in open position;

each shelf having a member at said one side of the cabinet engageable with the respective detent when the detent is in its first position and the lock bar is held in its first position by the locking member for locking the shelf in vending position;

said member on each shelf moving the respective detent to its second position for release of the shelf when, with the lock bar in its second position, the shelf is pulled out;

said locking member being at the bottom of the cabinet, the lower end of the lock bar being engageable with the locking member when the locking member is in its first position to lock the lock bar in its first position thereby to lock the detents in first position, the lock bar being biased upward to its first position and being movable downward against the bias to its second position when the locking member is in its second position;

said locking member being engageable with the lock bar when the lock bar is in its second position to lock the door in open position.

4. In a vendor as set forth in claim 2, interconnections between the detents and the lock bar for effecting movement of the lock bar to its second position when the locking member is moved to its second position on opening the door and any shelf is pulled out, thereby moving the respective detent to its second position.

5. In a vendor as set forth in claim 4 wherein each of said interconnections comprises a lug on the lock bar and a movable follower interposed between the respective detent and the lug, each detent having a cam formation engaging the respective follower for moving the follower to move the lock bar down to its second position when the detent moves to second position.

6. In a vendor as set forth in claim 5, said locking member being at the bottom of the cabinet, the lower end of the lock bar being engageable with the locking member when the locking member is in its first position to lock the lock bar in its first position thereby to lock the detents in first position, the lock bar being biased upward to its first position and being movable downward against the bias to its second position when the locking member is in its second position, the locking member being engageable with the lock bar when the lock bar is in its second position to lock the door in open position.

7. In a vendor as set forth in claim 6, each detent being pivotally mounted and having an open-ended slot receiving the said member on the respective shelf when the shelf is in vending position and the detent is in first position, said member swinging the detent to second position when the shelf is pulled out, said member then escaping from the slot, said member re-entering the slot when the shelf is pushed back in and swinging the detent back to its first position.

8. In a vendor as set forth in claim 7, each follower comprising a pivoted arm extending below the respective detent, spring means being provided for biasing the arm up into engagement with the cam formation on the respective detent, the cam formation swinging the arm down as the detent swings from first to second position.

9. In a vendor as set forth in claim 8, each detent and the respective arm being pivoted in a housing mounted in the cabinet on a partition adjacent said one side of the cabinet, the housing having a slot extending rearward from one end thereof constituting its forward end, said member on each shelf comprising a pin slidable forward in the slot of the respective housing from a position adjacent the rear end of the slot when the shelf is in vending position and out of the forward end of the slot, the detent with its open-ended slot receiving the pin being movable by the pin to its second position on pulling out the shelf when the lock bar is free to move to its second position, the pin then escaping from the slot in the detent and continuing on out through the slot in the housing, the pin re-entering the slot in the housing and then the slot in the detent when the shelf is pushed back in and swinging the detent back to its first position.

10. In a vendor as set forth in claim 9, said locking member comprising a shutter pivoted for swinging movement on a vertical axis on a support in the cabinet, the said interlock means further comprising a plate above the shutter, said plate and support having aligned holes in which the lower end portion of the lock bar is movable, the lower end of the lock bar being located in the hole in the plate when the lock bar is in its first position above the shutter, and moving down into the hole in the support when it moves down to its second position.

11. In a vendor comprising a cabinet having a front door hinged at one side of the cabinet to swing open and closed, a plurality of shelves in the cabinet for holding items to be vended, each shelf being mounted for sliding movement in rear-to-front direction for being pulled out from a vending position within the cabinet to a loading position extending forward from the cabinet when the door is swung open, interlock means for locking the shelves in said vending position unless the door is swung to an open position enabling the shelves to be slid out without striking the door, and for locking the door in open position unless all the shelves are slid in to their vending position, thereby to prevent the door from being struck by a shelf if the shelf is pulled out with the door only partly open, and to prevent the door from being closed against a pulled-out shelf, said interlock means comprising:

a locking member mounted in the cabinet at said one side thereof for movement between a first position wherein the door is unlocked and the shelves are locked in vending position, and a second position for locking the door in open position and unlocking the shelves;

means interconnecting the door and said locking member for movement of the locking member by the door from its first to its second position when the door is swung to its open position, and vice versa;

a lock bar mounted in the cabinet at said one side of the cabinet for up and down movement between a first position wherein the door is unlocked and the shelves are locked in vending position, and a second position wherein the door is locked in open position and the shelves are unlocked, said lock bar when in its first position being out of engagement with the locking member to enable movement of the locking member by the door;

said lock bar being prevented by said locking member from moving to its second position when the locking member is in its first position, and being movable to its second position when the locking member is in its second position;

a series of detents, one for each shelf, mounted in the cabinet at said one side of the cabinet for movement between a first position for unlocking the door and locking the shelves in vending position, and a second position for locking the door in open position and releasing the shelves;

each shelf having a member at said one side of the cabinet engageable with the respective detent when the shelf is pushed back into vending position to move the detent to its first position, thereby unlocking the door to enable it to be closed, said detent being movable to its second position for locking the door in open position when, with the lock bar in its second position, the shelf is pulled out, whereby, with the lock bar in its second position, one or more of the shelves may be pulled out at one time.

12. In a vendor comprising a cabinet having a front door hinged at one side of the cabinet to swing open and closed, a plurality of shelves in the cabinet for holding items to be vended, each shelf being mounted for sliding movement in rear-to-front direction for being pulled out from a vending position within the cabinet to a loading position extending forward from the cabinet when the door is swung open, interlock means for locking the shelves in said vending position unless the door is swung to an open position enabling the shelves to be slid out without striking the door, and for locking the door in open position unless all the shelves are slid in to their vending position, thereby to prevent the door from being struck by a shelf if the shelf is pulled out with the door only partly open, and to prevent the door from being closed against a pulled-out shelf, said interlock means comprising:

a locking member mounted in the cabinet at said one side thereof for movement between a first position wherein the door is unlocked and the shelves are locked in vending position, and a second position for locking the door in open position and unlocking the shelves;

means interconnecting the door and said locking member for movement of the locking member by the door from its first to its second position when the door is swung to its open position, and vice versa;

a lock bar mounted in the cabinet at said one side of the cabinet for up and down movement between a first position wherein the door is unlocked and the shelves are locked in vending position, and a second position wherein the door is locked in open position and the shelves are unlocked;

said lock bar being prevented by said locking member from moving to its second position when the locking member is in its first position, and being movable to its second position when the locking member is in its second position.

a series of detents, one for each shelf, mounted in the cabinet at said one side of the cabinet for movement between a first position for unlocking the door and locking the shelves in vending position, and a second position for locking the door in open position and releasing the shelves;

each shelf having a member at said one side of the cabinet engageable with the respective detent when the shelf is pushed back into vending position to move the detent to its first position, thereby unlocking the door to enable it to be closed, said detent being movable to its second position for locking the door in open position when, with the lock bar in its second position, the shelf is pulled out, the lock bar being engageable with the locking member when the locking member is in its first position to lock the lock bar in its first position thereby to lock the detents in first position;

said locking member being engageable with the lock bar when the lock bar is in its second position to lock the door in open position.

13. In a vendor comprising a cabinet having a front door hinged at one side of the cabinet to swing open and closed, a plurality of shelves in the cabinet for holding items to be vended, each shelf being mounted for sliding movement in rear-to-front direction for being pulled out from a vending position within the cabinet to a loading position extending forward from the cabinet when the door is swung open, interlock means for locking the shelves in said vending position unless the door is swung to an open position enabling the shelves to be slid out without striking the door, and for locking the door in open position unless all the shelves are slid in to their vending position, thereby to prevent the door from being struck by a shelf if the shelf is pulled out with the door only partly open, and to prevent the door from being closed against a pulled-out shelf, said interlock means comprising:

a locking member mounted in the cabinet at said one side thereof for movement between a first position wherein the door is unlocked and the shelves are locked in vending position, and a second position for locking the door in open position and unlocking the shelves;

means interconnecting the door and said locking member for movement of the locking member by the door from its first to its second position when the door is swung to its open position, and vice versa;

a lock bar mounted in the cabinet at said one side of the cabinet for up and down movement between a first position wherein the door is unlocked and the shelves are locked in vending position, and a second position wherein the door is locked in open position and the shelves are unlocked;

said lock bar being prevented by said locking member from moving to its second position when the locking member is in its first position, and being movable to its second position when the locking member is in its second position;

a series of detents, one for each shelf, mounted in the cabinet at said one side of the cabinet for movement between a first position for unlocking the door and locking the shelves in vending position, and a second position for locking the door in open position and releasing the shelves;

each shelf having a member at said one side of the cabinet engageable with the respective detent when the shelf is pushed back into vending position to move the detent to its first position, thereby unlocking the door to enable it to be closed, said detent being movable to its second position for locking the door in open position when, with the lock bar in its second position, the shelf is pulled out, the locking member being at the bottom of the cabinet, the lower end of the lock bar being engageable with the locking member when the locking member is in its first position, the lock bar being movable downward to its second position when the locking member is in its second position;

said locking member being engageable with the lock bar when the lock bar is in its second position to lock the door in open position.

14. In a vendor as set forth in claim 13, the locking member being pivoted for swinging movement on a vertical axis in the cabinet, the lower end of the lock bar being engageable with the top of the locking member to maintain the lock bar in first position when the locking member is in first position, the lock bar being released to move down to its second position when the locking member is moved to second position by the door.

* * * * *